US010819061B2

(12) United States Patent
Xia et al.

(10) Patent No.: US 10,819,061 B2
(45) Date of Patent: Oct. 27, 2020

(54) POWER CONNECTOR

(71) Applicant: Anhui Zhongding Sealing Parts Co., Ltd, Anhui (CN)

(72) Inventors: Yingsong Xia, Anhui (CN); Bing Liu, Anhui (CN); Zhipeng Wang, Anhui (CN); Binghu Fang, Anhui (CN); Aimin Li, Anhui (CN); Youhong Wang, Anhui (CN)

(73) Assignee: Anhui Zhongding Sealing Parts Co., Ltd, Anhui (CN)

( * ) Notice: Subject to any disclaimer, the term of this patent is extended or adjusted under 35 U.S.C. 154(b) by 0 days.

(21) Appl. No.: 16/492,940

(22) PCT Filed: Apr. 20, 2018

(86) PCT No.: PCT/CN2018/083931

§ 371 (c)(1),
(2) Date: Sep. 10, 2019

(87) PCT Pub. No.: WO2019/153515

PCT Pub. Date: Aug. 15, 2019

(65) Prior Publication Data

US 2020/0021053 A1 Jan. 16, 2020

(30) Foreign Application Priority Data

Feb. 8, 2018 (CN) ..... 2018 1 0129412

(51) Int. Cl.
*H01R 13/52* (2006.01)
*H01R 13/405* (2006.01)

(52) U.S. Cl.
CPC ..... *H01R 13/52* (2013.01); *H01R 13/405* (2013.01)

(58) Field of Classification Search
CPC ..... H01R 13/52
See application file for complete search history.

(56) References Cited

U.S. PATENT DOCUMENTS 4,360,861 A * 11/1982 Fitzgerald ..... F21V 19/0005 362/211
5,704,799 A * 1/1998 Wood ..... H01R 13/52 439/271

(Continued)

FOREIGN PATENT DOCUMENTS

CN 101601173 12/2009
CN 202205926 4/2012

(Continued)

OTHER PUBLICATIONS

"International Search Report (Form PCT/ISA/210) of PCT/CN2018/083931," dated Nov. 15, 2018, with English translation thereof, pp. 1-4.

*Primary Examiner* — James Harvey
(74) *Attorney, Agent, or Firm* — JCIP Global Inc

(57) ABSTRACT

Provided is a power connector, including a plurality of conductive frames and a rubber body, the first connecting hole is opened at one end of the conductive frame, and the second connecting hole is opened at the second end of the conductive frame, the plurality of conductive frames are arranged in parallel and spaced apart by a predetermined distance, and the middle portions of the plurality of conductive frames are connected by rubber vulcanization to form the rubber body. The power connector is provided in the present application, the rubber body isolates and fixes a plurality of conductive frames to form a power connector, the rubber body prevents arcing and breakdown of adjacent conductive frames due to spacing problems and positioning stability problems during high-voltage power transmission.

9 Claims, 1 Drawing Sheet

(56) References Cited

U.S. PATENT DOCUMENTS

| | | | | |
|---|---|---|---|---|
| 5,711,685 | A * | 1/1998 | Wood | H01R 13/5221 439/587 |
| 5,993,272 | A * | 11/1999 | Wood | H01R 4/027 439/891 |
| 7,618,287 | B2 * | 11/2009 | Hass | H01R 13/521 439/589 |
| 2009/0250885 | A1 * | 10/2009 | Sasaki | H01R 13/521 277/627 |
| 2010/0075535 | A1 * | 3/2010 | Mizutani | H01R 13/5216 439/588 |
| 2013/0102176 | A1 * | 4/2013 | Kazubowski | H01R 43/24 439/275 |
| 2014/0322973 | A1 * | 10/2014 | Okamoto | H01R 13/4223 439/587 |
| 2015/0126056 | A1 * | 5/2015 | Morita | H01R 13/5216 439/323 |
| 2015/0372415 | A1 * | 12/2015 | Ishihara | H01R 43/18 174/72 A |
| 2019/0067859 | A1 * | 2/2019 | Sugiura | H01R 13/2421 |
| 2020/0021053 | A1 * | 1/2020 | Xia | H01R 13/41 |

FOREIGN PATENT DOCUMENTS

| | | |
|---|---|---|
| CN | 103715544 | 4/2014 |
| CN | 105009376 | 10/2015 |

* cited by examiner

POWER CONNECTOR

CROSS-REFERENCE TO RELATED APPLICATION

This application is a 371 of international application of PCT application serial no. PCT/CN2018/083931, filed on Apr. 20, 2018, which claims the priority benefit of China application no. 201810129412.3, filed on Feb. 8, 2018. The entirety of each of the above mentioned patent applications is hereby incorporated by reference herein and made a part of this specification.

TECHNICAL FIELD

The present application relates to the field of electrical parts technology, and in particular, to a power connector.

BACKGROUND OF THE INVENTION

As countries pay more and more attention to global environmental protection, the concept of new energy vehicles has also developed rapidly. Electronic, power control unit and drive motor unit are key components of the new energy vehicle powertrain. It is a problem that how to form a stable and efficient connection between two of the above components to ensure that the drive motor can be effectively powered under different working conditions, while it is necessary to ensure that the connection components have the functions of sealing, shock absorption and insulation under the effective connection conditions.

SUMMARY OF THE INVENTION

In order to solve the technical problems existing in the background, the present invention proposes a power connector.

The present application provides a power connector, comprising a plurality of conductive frames and a rubber body, wherein the plurality of conductive frames are arranged in parallel and spaced apart by a predetermined distance, and the middle portions of the plurality of conductive frames are connected by rubber vulcanization to form the rubber body, the first connecting hole is opened at one end of the conductive frame, and the second connecting hole is opened at the second end of the conductive frame.

Preferably, the rubber body includes a first rubber portion and a second rubber portion, the first rubber portion and the second rubber portion are fixedly coupled and the first rubber portion is located on a side of the second rubber portion near the second end of the conductive frames, a limit step is formed at a joint between the first rubber portion and the second rubber portion.

Preferably, the thickness of the second rubber portion projected on an XZ plane gradually decreases in a positive direction of a Y-axis.

Preferably, the second rubber portion is provided with a plurality of sealing ribs parallel to each other, and each sealing rib annularly surrounds on an outer side of the second rubber portion, and a plane formed by each sealing rib is parallel to the XZ plane.

Preferably, the rubber body further includes a third rubber portion, the third rubber portion is composed of a plurality of rubber protrusions, and the plurality of rubber protrusions is located on a side of the second rubber portion away from the first rubber portion and fixedly connected to the second rubber portion, the plurality of rubber protrusions respectively coats on an outside of the plurality of conductive frames, and a gap is reserved between any adjacent rubber protrusions.

Preferably, the second end of the conductive frame is bent to form a multi-stage hem, and the second connecting hole is opened at an end of the multi-stage hem.

Preferably, the bending direction of the multi-stage hem is sequentially along a negative direction of a Z-axis, a negative direction of the Y-axis, the negative direction of the Z-axis, a positive direction of an X-axis, the negative direction of the Y-axis, and a positive direction of the Z-axis.

Preferably, the conductive frames are made of a material including Tu2 copper.

Preferably, the rubber body is made of a material including VMQ.

Preferably, surfaces of the conductive frames are tin-plated.

The power connector is provided in the present application, the rubber body isolates and fixes a plurality of conductive frames to form a power connector, the rubber body prevents arcing and breakdown of adjacent conductive frames due to spacing problems and positioning stability problems during high-voltage power transmission; The power connector proposed by the invention is applied to the rigid assembly connection between the electronic unit, the power unit and the driving motor unit, and in addition to realizing the high-voltage power transmission, the functions of fixing, sealing, insulating and damping can be realized.

DETAILED DESCRIPTION OF THE INVENTION

Figure 1:
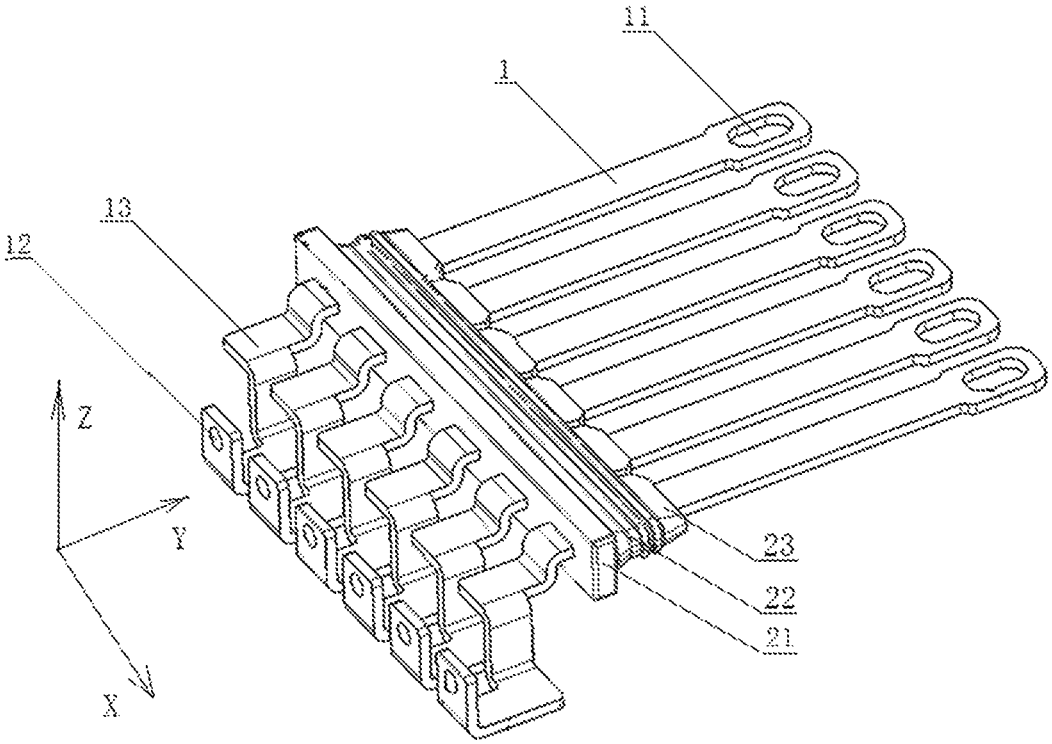
FIG. 1 is a schematic view of a power connector according to the present invention.
Figure 2:
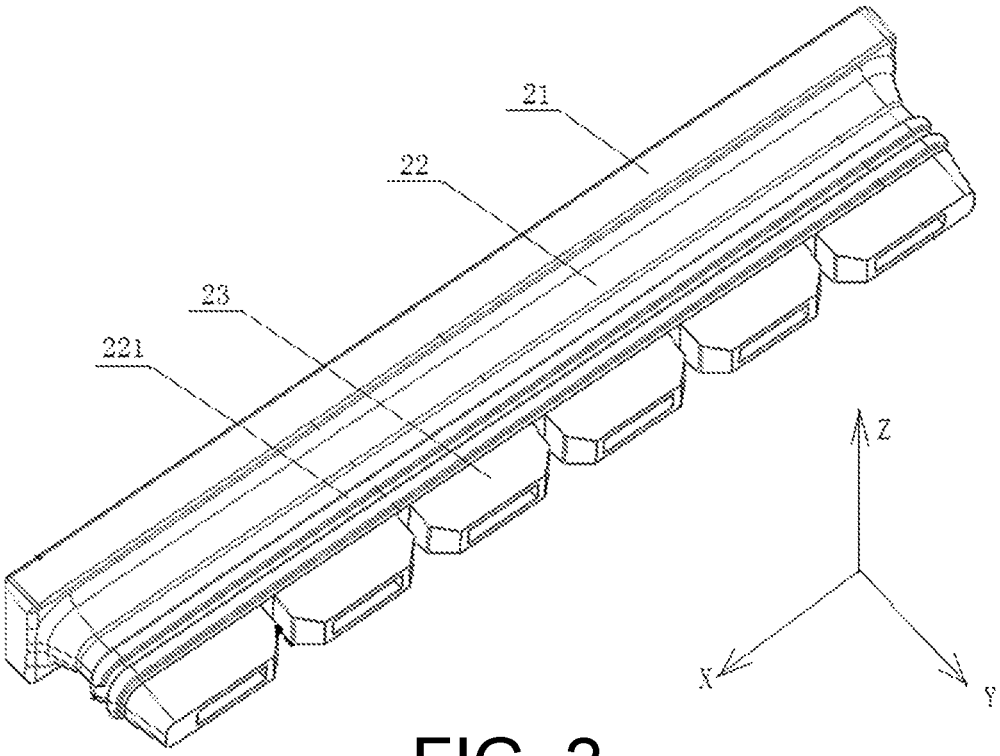
FIG. 2 is a schematic view of a rubber body of a power connector according to the present invention.

As shown in FIGS. 1-2, FIG. 1 is a schematic view of a power connector according to the present invention, and FIG. 2 is a schematic view of a rubber body of a power connector according to the present invention. The arrangement direction of the plurality of conductive frames 1 is defined as the X-axis direction, the length direction of the conductive frames 1 is defined as the Y-axis direction, and the positive direction of the Y-axis is directed to the first end of the conductive frames 1, the direction perpendicular to the arrangement direction of the plurality of conductive frames 1 is defined as the Z-axis direction.

Referring to FIG. 1, a power connector according to the present invention includes six conductive frames 1 and a rubber body. The first connecting hole 11 is opened at one end of each conductive frame 1, and the second connecting hole 12 is opened at the second end of each conductive frame 1. The six conductive frames are arranged in parallel and are equally spaced, and the middle portions of the six conductive frames 1 are connected by rubber vulcanization to form the rubber body. The rubber body isolates and fixes the six conductive frames 1 to form a set of power connectors. The rubber body isolates and fixes a plurality of conductive frames to form a power connector. The rubber body prevents arcing and breakdown of adjacent conductive frames due to spacing problems and positioning stability problems during high-voltage power transmission. And the power connector is fixed to the assembly housing by the rubber body.

Referring to FIG. 2, the rubber body is strip-shaped. The rubber body includes a first rubber portion 21, a second rubber portion 22, and a third rubber portion. The first rubber portion 21, the second rubber portion 22, and the third rubber portion are sequentially and fixedly connected along the positive direction of the Y-axis. A limit step is formed at the joint between the first rubber portion and the second rubber portion. When the rubber body is mated with the assembly housing, the limit step abuts against the assembly housing, which functions as limiting and fixing rubber body. The thickness of the second rubber portion projected on the XZ plane gradually decreases in the positive direction of the Y-axis. This facilitates the insertion of the rubber body into the assembly housing, which facilitates the insertion of the rubber body into the assembly housing during installation. It does not require too much effort to find the fit between the rubber body and the assembly housing. At the same time, two parallel sealing ribs 221 are formed on the outer side of the second rubber portion 22. Each sealing rib 221 annularly surrounds on the outer side of the second rubber portion 22, and the plane formed by each sealing rib 221 is parallel to the XZ plane. When the power connector is assembled, the sealing rib 221 is effectively fitted to the assembly housing to function as a waterproof seal. The third rubber portion includes six rubber protrusions 23. The six rubber protrusions 23 are located on the side of the second rubber portion 22 away from the first rubber portion 21 and are fixedly connected to the second rubber portion 22. The six rubber protrusions 23 respectively coats on the outside of the plurality of conductive frames 1. The power connector is effectively fixed to the assembly housing by the gap between the rubber projections 23.

The first connecting hole 11 has an elliptical shape, and the elliptical connecting hole can effectively compensate for assembly errors caused by positioning accuracy.

The second end of the conductive frame is bent to form a multi-stage hem 13. The bending direction of the multi-stage hem 13 is sequentially along the negative direction of the Z-axis, the negative direction of the Y-axis, the negative direction of the Z-axis, the positive direction of the X-axis, the negative direction of the Y-axis, and the positive direction of the Z-axis. The multi-stage hem 13 can avoid mutual interference of multiple conductive frames 1 when assembled. The second connecting hole 12 is opened at the end of the multi-stage hem 13, and the central axis of the second connecting hole 12 is perpendicular to the central axis of the first connecting hole 11.

In terms of materials, the conductive frames 1 are made of a material including oxygen-free copper (Tu2 copper), the rubber body is made of a material including silicon rubber (VMQ), the surfaces of the conductive frames 1 are tin-plated, which effectively improve the conductivity of the conductive frame 1.

The above is only the preferred embodiment of the present application, but the scope of protection of the present application is not limited thereto, and any equivalents or modifications of the technical solutions of the present application and the application concept thereof should be included in the scope of the present application within the scope of the technical scope of the present application.

What is claimed is:

1. A power connector, comprising: a plurality of conductive frames and a rubber body, wherein the plurality of conductive frames are arranged in parallel and spaced apart by a predetermined distance, and the middle portions of the plurality of conductive frames are connected by rubber vulcanization to form the rubber body, and a first connecting hole is opened at one end of each of the plurality of conductive frames, and a second connecting hole is opened at the second end of each of the plurality of conductive frames, wherein the second end of each of the plurality of conductive frames is bent to form a multi-stage hem, and the second connecting hole is opened at an end of the multi-stage hem.

2. The power connector according to claim 1, wherein the rubber body includes a first rubber portion and a second rubber portion, the first rubber portion and the second rubber portion are fixedly coupled and the first rubber portion is located on a side of the second rubber portion near the second end of the conductive frames, a limit step is formed at a joint between the first rubber portion and the second rubber portion.

3. The power connector according to claim 2, wherein a thickness of the second rubber portion projected on an XZ plane gradually decreases in a positive direction of a Y-axis.

4. The power connector according to claim 2, wherein the second rubber portion is provided with a plurality of sealing ribs parallel to each other, and each sealing rib annularly surrounds on an outer side of the second rubber portion, and a plane formed by each sealing rib is parallel to the XZ plane.

5. The power connector according to claim 2, wherein the rubber body further includes a third rubber portion, the third rubber portion is composed of a plurality of rubber protrusions, and the plurality of rubber protrusions is located on a side of the second rubber portion away from the first rubber portion and fixedly connected to the second rubber portion, the plurality of rubber protrusions respectively coats on an outside of the plurality of conductive frames, and a gap is reserved between any adjacent rubber protrusions.

6. The power connector according to claim 1, wherein surfaces of the conductive frames are tin-plated.

7. The power connector according to claim 1, wherein a bending direction of the multi-stage hem is sequentially along a negative direction of a Z-axis, a negative direction of the Y-axis, the negative direction of the Z-axis, a positive direction of an X-axis, the negative direction of the Y-axis, and a positive direction of the Z-axis.

8. The power connector according to claim 1, wherein the conductive frames are made of a material including oxygen-free copper (Tu2 copper).

9. The power connector according to claim 1, wherein the rubber body is made of a material including silicon rubber (VMQ).

* * * * *